US011623115B1

(12) United States Patent
Fleischman et al.

(10) Patent No.: US 11,623,115 B1
(45) Date of Patent: Apr. 11, 2023

(54) SIZE-ADJUSTABLE WEIGHT PLATE ACCEPTING TRAINING DEVICE

(71) Applicant: Setsmart LLC, Brooklyn, NY (US)

(72) Inventors: Mindy Fleischman, Brooklyn, NY (US); Samuel Stern, Brooklyn, NY (US)

(73) Assignee: Setsmart LLC, Brooklyn, NY (US)

( * ) Notice: Subject to any disclaimer, the term of this patent is extended or adjusted under 35 U.S.C. 154(b) by 0 days.

(21) Appl. No.: 17/895,011

(22) Filed: Aug. 24, 2022

(51) Int. Cl.
*A63B 21/00* (2006.01)
*A63B 21/06* (2006.01)

(52) U.S. Cl.
CPC .... *A63B 21/00065* (2013.01); *A63B 21/0604* (2013.01); *A63B 21/4034* (2015.10); *A63B 2225/09* (2013.01)

(58) Field of Classification Search
CPC ..... A63B 21/00065; A63B 21/0604; A63B 21/4034; A63B 23/0205; A63B 23/0211; A63B 23/0216; A63B 23/0222; A63B 23/0227; A63B 2225/09
See application file for complete search history.

(56) References Cited

U.S. PATENT DOCUMENTS 4,408,759 A * 10/1983 Reneau ..... A63B 21/4045 482/114
4,632,393 A * 12/1986 Van Noord ..... A63B 21/00065 482/133
5,616,109 A * 4/1997 Szu-Ming ..... A63B 21/4047 482/130
7,108,642 B1 * 9/2006 Stearns ..... A63B 23/0211 482/121
7,374,518 B2 * 5/2008 Ratner ..... A63B 21/0552 482/136
7,569,005 B2 * 8/2009 Geeting ..... A63B 21/0004 482/121
8,096,930 B1 * 1/2012 Leon ..... A63B 21/00181 482/130
9,849,365 B2 * 12/2017 Faucette ..... A63B 69/3667
9,878,203 B1 * 1/2018 Guarnaccia ..... A63B 21/00047
10,123,736 B2 * 11/2018 Malone ..... A61B 5/4833
11,130,013 B2 * 9/2021 Tabone ..... A63B 21/0724
2006/0014614 A1 * 1/2006 Szabo ..... A63B 21/0552 482/121
2007/0042880 A1 * 2/2007 Ratner ..... A63B 21/0552 482/121
2017/0028287 A1 * 2/2017 Faucette ..... A63B 69/3667
2020/0114193 A1 * 4/2020 Tabone ..... A63B 21/0783

* cited by examiner

*Primary Examiner* — Joshua Lee
(74) *Attorney, Agent, or Firm* — Bochner IP, PLLC; Andrew D. Bochner

(57) ABSTRACT

A training device may include a frame. The frame may include a main shaft having proximal and distal ends; a left mount and a right mount each disposed perpendicular to the main shaft; a weight guard extending radially from the main shaft; a sheath protruding from the main shaft; and a fastener well disposed on the sheath. Further, the training device may include a t-bar. The t-bar may include a support member comprising a plurality of holes. The sheath may be sized to accept the support member. A left rail and a right rail may each be disposed orthogonal to the support member.

18 Claims, 3 Drawing Sheets

SIZE-ADJUSTABLE WEIGHT PLATE ACCEPTING TRAINING DEVICE

FIELD OF THE DISCLOSURE

The present disclosure relates to apparatuses for body training and weight training. Specifically, the present disclosure relates to training the lower extremities with a device that may couple with a plurality of weights, and methods thereof.

INTRODUCTION

Proper strength training may promote longevity and prevent injury by ensuring all the components of the body are functioning in proper alignment. Injury may result when one body part is compensating for another, therefore being overexerted. However, this issue may be preventable by proper strength training of all the muscle groups. An often-overlooked muscle group that may be trained is the tibialis anterior muscle. Proper training of the tibialis anterior muscle may aid in overall leg strength which may promote balance and resiliency of the leg muscles.

Presently, training devices exist that may target strengthening of the tibialis anterior muscle. Such devices may utilize weight bearing exercises so that a user may target specific muscle groups. The user may perform leg reps that aim to strengthen the tibialis anterior muscle. Such a device requires the user to secure the device to their feet so that the reps may be performed. However, due to varying foot sizes among users, the device may either be sized for a specific user or may not be interchangeable across different users.

Therefore, it would be desirable to provide a device where the user may adjust the foot securements of the device such that they fit the user's foot size. Such a device may enable various users to share in using the device, a practice that is common at public gyms. Further, a user may be assured that their foot fits the device upon procurement, rather than measuring the device with the user's foot prior to use. Such a device may provide for a more inclusive user audience seeking to strengthen their tibialis anterior muscle.

SUMMARY

This Summary is provided to introduce a selection of concepts in a simplified form that are further described below in the Detailed Description. This Summary is not intended to identify key features or essential features, nor is it intended to limit the scope of the claims included herewith.

An aspect of the present disclosure may comprise a training device including a frame and a t-bar. The frame may include a main shaft having a proximal end, and a distal end, and a left mount and a right mount each disposed perpendicular to the proximal end of the main shaft. The left mount and the right mount may be insulated with a left padding and right padding respectively. The frame may further include a weight guard extending radially from the main shaft, a sheath protruding from the main shaft, and a fastener well disposed on the sheath. The t-bar may include a support member comprising a plurality of holes, and a left rail and a right rail each disposed orthogonal to the support member. The sheath may be sized to accept the support member.

In an embodiment, the left mount and the right mount may be insulated with a left padding and right padding respectively.

In another embodiment, the fastener well may be sized to interface with the plurality of holes.

In yet another embodiment, the training device may further include an indexing fastener. The indexing fastener may be sized to be accepted by the interface of the fastener well and plurality of holes.

In a further embodiment, the indexing fastener may include a handhold.

In an embodiment, the frame may be cylindrical.

In another embodiment, the left rail, right rail, and support member may be cylindrical.

In yet another embodiment, there may be 3 fastener wells disposed on the sheath.

In a further embodiment, the support member may include a weighted solid material. The weighted solid material may be lead.

An aspect of the present disclosure may include a training device. The training device may include a frame and a t-bar. The frame may include a main shaft having a proximal end, and a distal end; a left mount and a right mount each disposed perpendicular to the proximal end of the main shaft; a weight guard extending radially from the main shaft; a sheath protruding from the main shaft; and a fastener well disposed on the sheath. The left mount and the right mount may be insulated with a left padding and right padding respectively. The t-bar may include a support member comprising a plurality of holes, and a left rail and a right rail each disposed orthogonal to the support member. The sheath may be sized to accept the support member.

In an embodiment, the left and right padding may rotate freely about the left mount and the right mount respectively.

In another embodiment, the training device may further include a fastener well, the fastener well may be sized to interface with the plurality of holes.

In yet another embodiment, an indexing fastener may be sized to be accepted by the interface of the fastener well and plurality of holes. The indexing fastener may include a handhold.

In a further embodiment, the frame may be cylindrical.

In an embodiment, the left rail, right rail, and support member may be cylindrical.

In another embodiment, there may be 3 fastener wells disposed on the sheath.

In yet another embodiment, the support member may include a weighted solid material. The weighted solid material may be lead.

BRIEF DESCRIPTION OF THE DRAWINGS

Objects, aspects, features, and advantages of embodiments disclosed herein will become more fully apparent from the following detailed description, the appended claims, and the accompanying drawing figures in which like reference numerals identify similar or identical elements. Reference numerals that are introduced in the specification in association with a drawing figure may be repeated in one or more subsequent figures without additional description in the specification in order to provide context for other features, and not every element may be labeled in every figure. The drawing figures are not necessarily to scale, emphasis instead being placed upon illustrating embodiments, principles and concepts. The drawings are not intended to limit the scope of the claims included herewith.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

Figure 1:
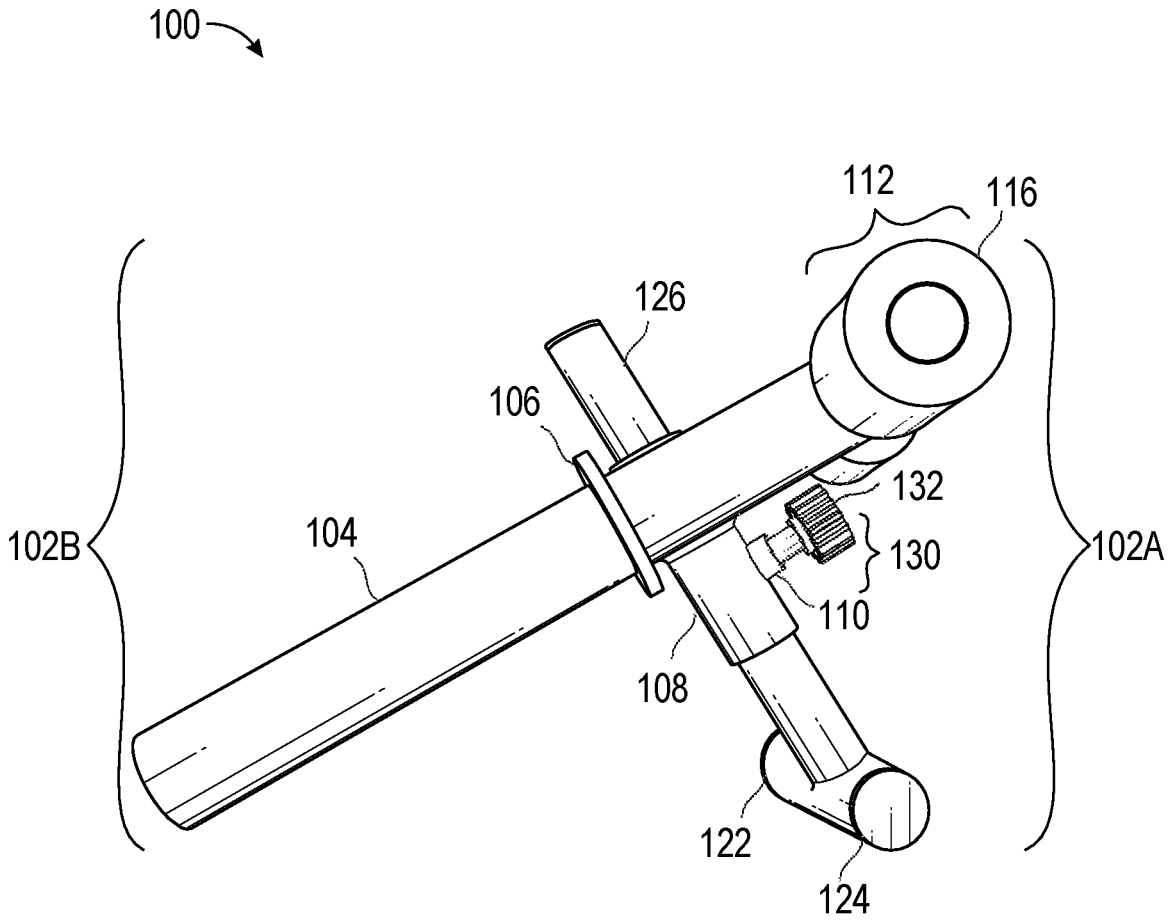
FIG. 1 shows a perspective view of a training device according to aspects of the present disclosure.

FIG. 1 illustrates a perspective view of the training device 100 for supporting weighted training of the lower extremities. The training device 100 may include a frame 102. The frame 102 may be composed of any weight-bearing material, including but not limited to aluminum and other suitable metals. However, the frame 102 may be any material suitable for withstanding the applied weight, such as certain plastics. The walls of the frame 102 may have a thickness. For example, the thickness may be 2 mm, however the thickness may be any suitable dimension. In an embodiment, the frame 102 is completely solid, such that the thickness is equal to the outer dimensions of the frame 102. In an embodiment, the thickness of the training device 100 may uniform throughout the training device 100. In an alternate embodiment, the parts comprising the training device 100 may have distinct weights such that they may withstand the different forces applied upon them. The frame 102 may be configured generally in a T-shape. However, the frame 102 may embody any suitable shape and dimensions. The frame 102 may be structured as to accept and withstand one or more weights.

In an embodiment, the frame 102 may be composed of a main shaft 104, a weight guard 106, a sheath 108, a left mount 112, and/or a right mount 114. The main shaft 104 may be cylindrical in shape. The main shaft 104 may be sized to accept one or more standard weight plates. Further, the main shaft 104 may be sized to be compatible with a standard weight clamp to prevent one or more weight plates from sliding off the main shaft 104. In an embodiment, an exemplary weight plate is outfitted with a hole at its center. However, the main shaft 104 may be a rectangular prism, a triangular prism, or any other suitable geometry. Further, the main shaft 104 may be sized to accept weight plates of any complementary standard. For example, the main shaft 104, or portions thereof, may be sized to complement the hole (or other attachment means) of the weight plate. The main shaft 104 may have a length. Further, the main shaft 104 may have a diameter and a wall thickness. For example, the length may be approximately 420 mm and the diameter may be approximately 50 mm, however, the present disclosure is not limited to these measurements.

The frame 102 may comprise a frame proximal end 102A and a frame distal end 102B. The frame proximal end 102A may be located closer to the left mount 112 and right mount 114. The frame distal end 102B may be located further from the left mount 112 and right mount 114.

The frame 102 may include a weight guard 106. The weight guard 106 may be a ridge encircling the circumference of the main shaft 104. The weight guard 106 may extend radially from the main shaft 104. In an embodiment, the circumference of the weight guard 106 may be greater than the circumference of the hole on a standard weight plate. However, the weight guard 106 may be any circumference which enables the uses of the present disclosure. Accordingly, the weight guard 106 may prevent the one or more weight plates from surpassing the weight guard 106. The weight plates may be linked onto the device on the frame distal end 102. Further, the presence of the weight guard 106 on the frame proximal end 102A may prevent the weight plates from continuing onto the frame proximal end 102A. The weight guard 106 may enable the training device 100 to accept a plurality of weights. The weight guard 106 may further be configured so the weight(s) accepted by the main shaft 104 may halt a distance along the main shaft 104. This halt distance may be any suitable distance between a proximal side of the support member 126 and the distal end 102B of the main shaft 104. Thus, the weight guard 106 may be positioned as to maintain the weight at a distance from the user's feet to induce a desired force effect. For example, the weight guard 106 may be disposed in a position adapted to induce a particular torque upon the user's feet.

The frame 102 may further comprise a sheath 108. The sheath 108 may be cylindrical in shape with a hollow cavity. The sheath 108 may intersect the main shaft 104 at a right angle. However, the sheath 108 may intersect the main shaft 104 at other angles depending on the desired properties of the training device 100. For example, the sheath 108 may intersect the main shaft 104 at a 45-degree angle, such that the change in the magnitude of support member 126 insertion (discussed in greater detail below) changes the angle between the main shaft 104 and the floor at a lesser rate than having a 90-degree intersection angle between the sheath 108 and main shaft 104. The sheath 108 may have a length and a diameter. For example, the sheath 108 may have a length of 65 mm and a diameter which is greater than the diameter of the support member 126, so as to enable passage of the support member 126 through an opening defined by the diameter of the sheath 108. However, the present disclosure is not limited by the length and diameter of the sheath 108. Accordingly, the sheath 108 may also be shaped to any geometry sized to accept the t-bar 120 as described further below.

A fastener well 110 may protract from the sheath 108. The fastener well 110 may be sized to interface with a screw-like object, such as but not limited to an indexing fastener 130. The fastener well 110 may be orthogonal to the outer wall of the sheath 108. In an embodiment, the fastener well 110 may be larger in circumference than the indexing fastener 130 to enable the assembly of the indexing fastener 130 to the fastener well 110. However, the fastener well 110 may be any circumference sized to interface with a screw-like object. In an embodiment, the are multiple fastener wells 110 protracting from the sheath 108. In an embodiment, there are 3 fastener wells 110.

The frame 102 may further comprise a left mount 112 and a right mount 114. The left mount 112 and right mount 114 may be continuous components of the main shaft 104. The left mount 112 and the right mount 114 may be disposed perpendicular to the main shaft 104 so that respective 90-degree angles are formed between the main shaft 104 and the left mount 112 and the right mount 114, respectively. The left mount 112 and the right mount 114 may be sized to enable the user to affix their feet to the training device 100. The left mount 112 and the right mount 114 may be identical in size and shape. The left mount 112 and the right mount 114 may have respective lengths, such that a standard user's feet may sufficiently utilize the left mount 112 and the right mount 114. However, the present disclosure is not limited by the disclosed length. The left mount 112 and the right mount 114 may be configured to withstand force by the user.

The left mount 112 and right mount 114 may be insulated with a left padding 116 and a right padding 118. The left padding 116 and the right padding 118 may be secured in place onto the left mount 112 and the right mount 114 such that they may not be adjusted. In an alternate embodiment, the left padding 116 and the right padding 118 may be able to freely rotate about the left mount 112 and the right mount 114 such that they may be adjusted. The left padding 116 and the right padding 118 may be a soft, spring-like material. For example, the left padding 116 and the right padding 118 may be composed of foam, rubber, or plastic. However, the left padding 116 and the right padding 118 may be composed of any material which aligns with the present uses of this disclosure. The material may mitigate pressure imposed by the left mount 112 and the right mount 114 on the user's feet. The left and right padding 116/118 may have a thickness configured to provide comfort to the user when using the training device 100. The thickness may be in the range of 0.5-2.0 inches. However, any suitable thickness may be used depending on the desired amount of padding. The left padding 116 and the right padding 118 may be both composed of the same material. The material may enable gripping with the user's shoes and the left mount 112 and right mount 114. The material may interact with the user's shoes such that the user's shoes remain supported. The left and right padding 116/118 may be constructed from a material having a porous property so as to wick away sweat from the user's feet which may accumulate while the training device 100 is in use.

In an embodiment, the left padding 116 and the right padding 118 may be removable from the left mount 112 and the right mount 114, respectively. In an alternate embodiment, the left padding 116 and the right padding 118 may be fastened using adhesive or another suitable fastener. For example, adhesives may include cyanoacrylate, polyurethane adhesive, epoxy glue, or craft glue. In an embodiment, the user may secure their feet to the left mount 112 and the right mount 114 using one or more straps, with or without the presence of the left padding 116 and the right padding 118.

The training device 100 may include a t-bar 120. The t-bar 120 may be composed of any suitable material configured to withstand force by the user. For example, forces exerted on this device may include but are not limited to normal force, friction force, gravitational force, and applied force. The t-bar 120 may be composed of metal, however, this disclosure is not limited to the material of the t-bar 120. The t-bar 120 may function in tandem with the left mount 112 and the right mount 114 so that a user's foot may be secured between the t-bar 120 and the left mount 112 and the right mount 114 respectively. The supplementary segments may enable the user to secure their feet to the training device 100.

The t-bar 120 may be composed of a left rail 122, a right rail 124, and/or a support member 126. The left rail 122 and the right rail 124 may be continuous components of the support member 126. The left rail 122 and the right rail 124 may be perpendicular to the support member 126 so that the left rail 122 and the right rail 124 each form 90-degree angles with the support member 126. The left rail 122 and the right rail 124 may be identical in size and shape. The left rail 122 and the right rail 124 may include a length. For example, the left rail 122 and the right rail 124 may be 175 mm in length respectively. However, any suitable length may be used.

The left rail 122, the right rail 124, and the support member 126 may be cylindrical in shape. However, it is contemplated that other suitable shapes may be used, such as triangular or squared. The support member 126 may have a hollow cavity. In an alternate embodiment, the support member 126 may have a solid core. The solid core may have a desired weight. In such an embodiment, the solid core comprises a dense material, such as lead or other heavy metal. By having a solid core having a desired weight, the center of gravity of the training device 100 may be lowered, which may prevent the training device 100 form toppling over when in use. Further, the left rail 122 and the right rail 124 may have a hollow core or a solid core such that the uses of the present disclosure are enabled.

The support member 126 may be sized to be greater in length than the left rail 122 or the right rail 124. In an alternate embodiment, the length of the support member 126 may be less than the length of the left rail 122 and the right rail 124. In yet a further alternate embodiment, the support member 126 may be the same length as the left rail 122 or the right rail 124. In a further embodiment, the left rail 122 and the right rail 124 may comprise a length such that a standard user's feet may sufficiently utilize the left rail 122 and the right rail 124. The left rail 122 and the right rail 124 may be configured to withstand force by the user.

The support member 126 may include a stopping feature (not shown). The stopping feature may function to prevent the support member 126 from being fully removed from the sheath 108. In an embodiment, the stopping feature is a bump on the surface of the support member 126 which prevents the support member 126 from passing through the sheath 108. The stopping feature may be an adjustable clamp, such that a user may attach the clamp at a desired position along the support member 126 to prevent the support member 126 from passing through the sheath 108 past the point at which the clamp is attached. In an embodiment, an elastic band may be used instead of a clamp. The elastic band may be constructed using rubber.

A plurality of holes 128 may be disposed on the walls of the support member 126. The plurality of holes 128 may comprise three holes, however, the present disclosure is not limited to the number of holes and any suitable number of holes may be used depending on the desired adjustability of the training device 100. When the t-bar 120 is coupled with the sheath 108, the plurality of holes 128 may overlap the fastener well 110. The plurality of holes 128 may be further sized to accept the indexing fastener 130.

The sheath 108 may be sized to accept the support member 126. The sheath 108 may be greater in diameter to enable the securement of the support member 126.

Any of the main shaft 104, left rail 122, right rail 124, support member 126, left mount 112, or right mount 114 may include one or more caps. The one or more caps may be positioned to cover an end of the respective part which it is disposed upon. For example, the main shaft 104 may include a cap at its distal end 102B to cover a hollow cavity of the main shaft 104. The one or more caps may be constructed from a variety of suitable materials including metal, polyethylene, or composite material.

The t-bar 120 may be secured to the frame 102 by the fastener well 110, the plurality of holes 128 and the indexing fastener 130. The sheath 108 may accept the support member 126. Upon securement, the user may adjust the t-bar 120. The user may adjust the magnitude of support member 126 insertion by retracting and/or withdrawing the support member 126 relative to the sheath 108. Accordingly, the magnitude of support member 126 insertion may be a function of the selected hole 128. Adjusting the magnitude of support member 126 insertion may allow a user to achieve an optimal fit of the training device 100.

Adjustment of the t-bar 120 may be facilitated by the plurality of holes 128. The user may modify the t-bar 120 to a plurality of adjustments. The plurality of adjustments is dependent on the hole the user selects from the plurality of holes 128. For example, the t-bar 120 may have three holes. Therefore, the t-bar 120 may be modified to three adjustments. However, the present disclosure is not limited to the number of adjustment sizes. The elected placement of the t-bar 120 corresponds with the alignment of the left mount 112 and the right mount 114. The elected placement may further correspond with the size of the user's foot so that the user's foot comfortably rests in between the t-bar 120 and the left mount 112 and the right mount 114, respectively.

The user may choose from a plurality of adjustments for the t-bar 120 placement that correspond with the plurality of holes 128. The user may select a hole from the plurality of holes 128 that corresponds to the adjustment for the t-bar 120. To adjust the size, the user may arrange the selected hole from the plurality of holes 128 so that it is aligned with the fastener well 110. The user may secure the t-bar 120 to the sheath 108 by utilizing the indexing fastener 130.

The indexing fastener 130 may comprise a handhold 132 for ease of fastening. The handhold 132 may be comprised of grips to enable the user to readily grasp the indexing fastener 130. In an embodiment, the handhold 132 may be comprised of a material to enable the grasping of the indexing fastener 130, such as a rubber or plastic. However, the present disclosure is not limited by the material used for the handhold 132. The grips may not be present on the portion of the handhold 132 that secures into the fastener well 110.

Upon alignment of the selected hole with the fastener well 110, the user may secure the indexing fastener 130 to the fastener well 110 by performing a rotational motion until the indexing fastener 130 is secured to the elected hole of the t-bar 120. Once the indexing fastener 130 is secured in the fastener well 110, the handhold 132 may continue to be visible. The fastener well 110 may be designed to not permit entry of the handhold 132 into the fastener well 110 to ensure eventual removal of the indexing fastener 130 from the fastener well 110. This securement may be able to withstand force by the user. Alternate means of fastening may be utilized such as but not limited to a cotter pin and twist and pull fasteners.

The plurality of holes 128 may be embossed with threading. The threading may enable the indexing fastener 130 to secure to the fastener well 110, preventing the indexing fastener 130 from sliding in place. The fastener well 110 may be further comprised with threading to ensure supplemental securement. In an alternate embodiment, the indexing fastener 130 may secure itself through the support member 126 through the sheath 108 entirely so that the indexing fastener 130 may be secured by an alternate means such as but not limited to a cotter pin.

The training device 100 may enable a maximum capacity of weight bearing. This amount may be up to 120 kgs, however the present disclosure is not limited by the maximum capacity and any maximum capacity may be utilized.

In an embodiment, the training device 100 may be configured so that it can rest on a flat surface, such as a gym floor. The training device 100 may rest flatly so that the t-bar 120 may be positioned on the floor. The main shaft 104 may also rest on the floor so that the t-bar 120 and the main shaft 104 may interface at a right angle with the floor wherein the side making up the floor is the hypotenuse.

FIG. 1 shows a view of the training device 100 wherein the training device 100 rests on a flat surface. The training device 100 may rest on a flat surface wherein the left rail 122, the right rail 124, and the frame distal end 102B sit on the flat surface.

Figure 2:
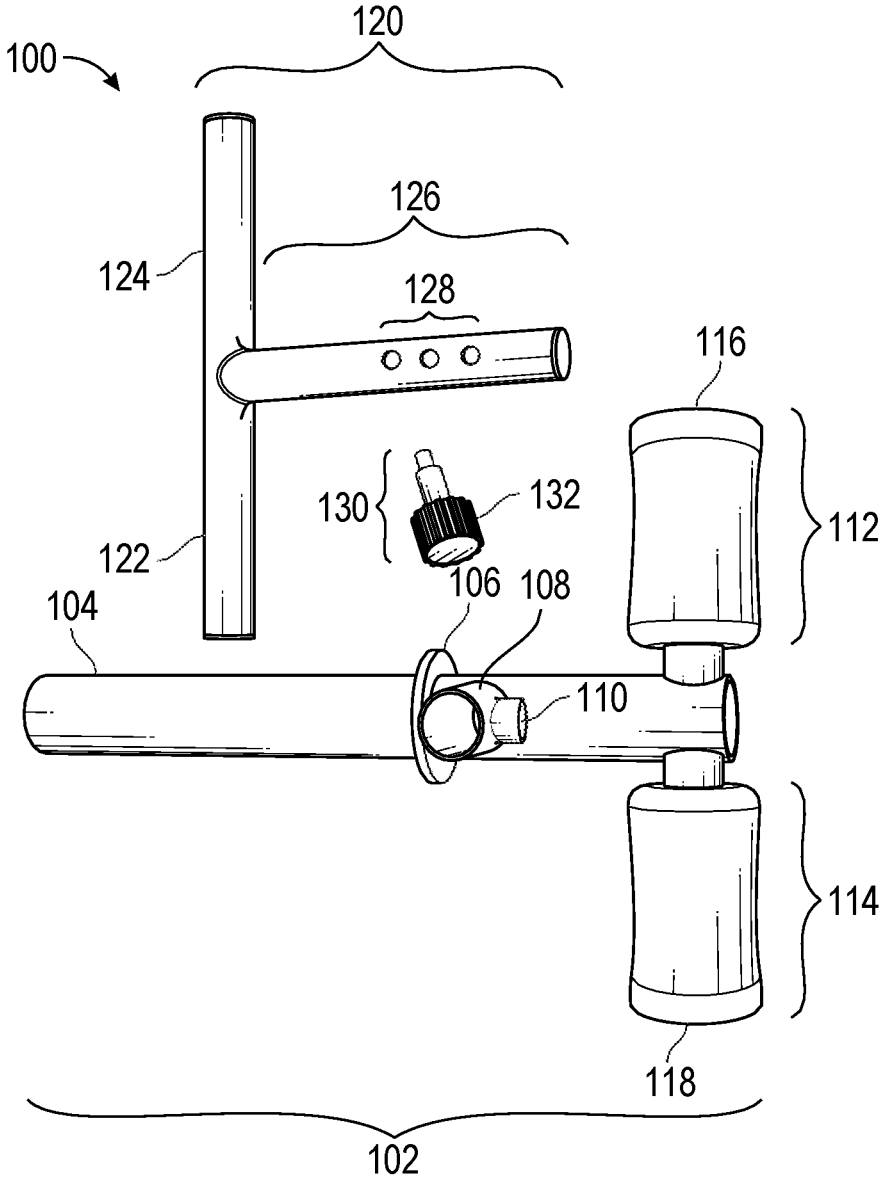
FIG. 2 shows an aerial view of a disassembled training device according to aspects of the present disclosure.

FIG. 2 shows a disassembled view of the training device 100 wherein the three parts making up the training device 100, the frame 102, the t-bar 120, and the indexing fastener 130 are shown separately.

Figure 3:
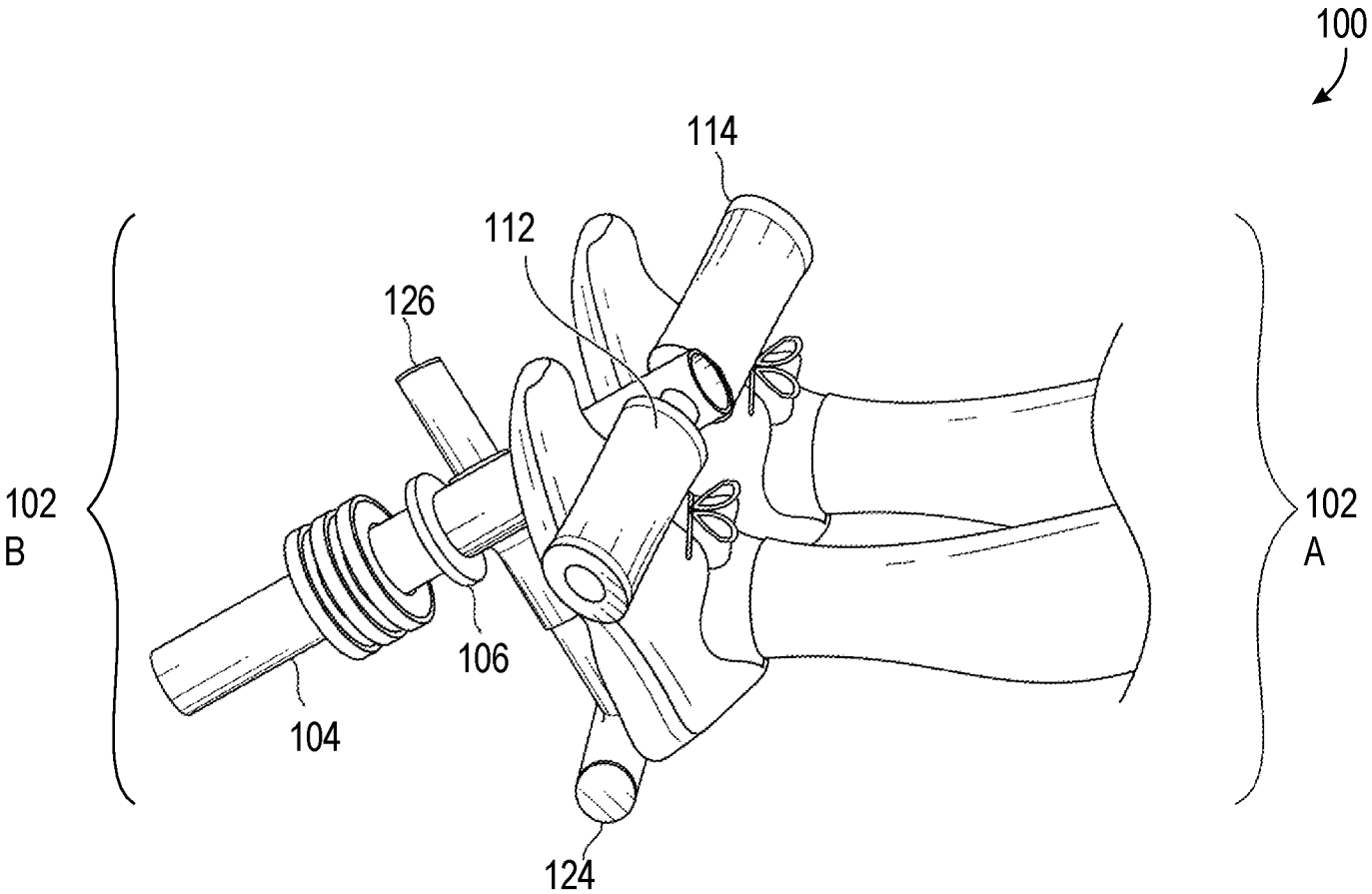
FIG. 3 shows a view of a training device in use according to aspects of the present disclosure.

FIG. 3 shows a diagram of the training device 100 in use. The user may secure the left foot so that the toe rests under the left mount 112 and the heel rests upon the right rail 124. Further, the user may secure the right foot so that the toe rests under the right mount 114 and the heel rests upon the left rail 122.

Various elements, which are described herein in the context of one or more embodiments, may be provided separately or in any suitable sub-combination. Further, the processes described herein are not limited to the specific embodiments described. For example, the processes described herein are not limited to the specific processing order described herein and, rather, process blocks may be re-ordered, combined, removed, or performed in parallel or in serial, as necessary, to achieve the results set forth herein.

It will be further understood that various changes in the details, materials, and arrangements of the parts that have been described and illustrated herein may be made by those skilled in the art without departing from the scope of the following claims.

All references, patents and patent applications and publications that are cited or referred to in this application are incorporated in their entirety herein by reference. Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A training device comprising:

a frame including:

a main shaft having a proximal end, and a distal end;

a left mount and a right mount each disposed perpendicular to the proximal end of the main shaft;

a weight guard disposed along a total circumference of the main shaft and extending radially from the main shaft;

a sheath protruding from the main shaft; and a fastener well disposed on the sheath;

a t-bar comprising:

a support member comprising a plurality of holes;

wherein the sheath is sized to accept the support member; and a left rail and a right rail each disposed orthogonal to the support member.

2. The training device of claim 1, further including a stopping feature disposed on an exterior surface of the support member.

3. The training device of claim 1, wherein the fastener well is sized to interface with the plurality of holes.

4. The training device of claim 1, further including an indexing fastener, wherein the indexing fastener is sized to be accepted by the interface of the fastener well and plurality of holes.

5. The training device of claim 4, wherein the indexing fastener includes a handhold.

6. The training device of claim 1, wherein the frame is cylindrical.

7. The training device of claim 1, wherein the left rail, right rail, and support member are cylindrical.

8. The training device of claim 1, wherein the support member includes a weighted solid material.

9. A training device comprising:

a frame including:

a main shaft having a proximal end, and a distal end;

a left mount and a right mount each disposed perpendicular to the proximal end of the main shaft, wherein the left mount and the right mount are insulated with a left padding and right padding respectively;

a weight guard disposed along a total circumference of the main shaft and extending radially from the main shaft;

a sheath protruding from the main shaft; and a fastener well disposed on the sheath;

a t-bar comprising:

a support member comprising a plurality of holes;

wherein the sheath is sized to accept the support member; and a left rail and a right rail each disposed orthogonal to the support member.

10. The training device of claim 9, wherein the left and right padding rotate freely about the left mount and the right mount respectively.

11. The training device of claim 9, wherein the fastener well is sized to interface with the plurality of holes.

12. The training device of claim 9, further including an indexing fastener, wherein the indexing fastener is sized to be accepted by the interface of the fastener well and plurality of holes.

13. The training device of claim 12, wherein the indexing fastener includes a handhold.

14. The training device of claim 1, wherein the frame is cylindrical.

15. The training device of claim 1, wherein the left rail, right rail, and support member are cylindrical.

16. The training device of claim 1, wherein the support member includes a weighted solid material.

17. The training device of claim 16, wherein the weighted solid material is lead.

18. A training device comprising:

a frame including:

a main shaft having a proximal end, and a distal end;

a left mount and a right mount each disposed perpendicular to the proximal end of the main shaft;

a weight guard extending radially from the main shaft;

a sheath protruding from the main shaft; and a fastener well disposed on the sheath;

a t-bar comprising:

a support member comprising a plurality of holes;

wherein the sheath is sized to accept the support member, and wherein the support member includes a weighted lead material; and a left rail and a right rail each disposed orthogonal to the support member.

* * * * *